United States Patent [19]

Casparro

[11] 3,972,140

[45] Aug. 3, 1976

[54] PORTABLE DYNAMIC ADVERTISING DISPLAY SYSTEM

[75] Inventor: John J. Casparro, Canoga Park, Calif.

[73] Assignee: Don Fedderson Productions Inc., Studio City, Calif.

[22] Filed: Jan. 15, 1975

[21] Appl. No.: 541,268

[52] U.S. Cl. ..... 40/32; 40/78.09; 40/106.31; 98/177 R

[51] Int. Cl.[2] ..... G09F 11/28

[58] Field of Search ..... 40/32, 78.09, 96, 96.5, 40/78.07, 106.31, 36, 125 H; 198/177 R, 177 T, 203

[56] References Cited

UNITED STATES PATENTS

| | | | |
|---|---|---|---|
| 1,329,653 | 2/1920 | Crippen | 40/106.31 |
| 1,717,246 | 6/1929 | Perling | 198/177 R X |
| 2,944,658 | 7/1960 | Zebley | 198/177 R |
| 2,997,133 | 8/1961 | Gehrke | 198/177 R X |
| 3,231,065 | 1/1966 | Kaminski et al. | 198/203 X |
| 3,577,930 | 5/1971 | Rooklyn | 198/177 R X |
| 3,598,060 | 8/1971 | Chitra | 198/177 R X |
| 3,633,736 | 1/1972 | Golden | 198/177 R X |
| 3,642,120 | 2/1972 | Duhan | 198/203 |
| 3,735,513 | 5/1973 | Constant et al. | 40/32 |
| 3,812,953 | 5/1974 | Maschke | 198/203 X |
| 3,849,919 | 11/1974 | Gravelle et al. | 40/32 |

*Primary Examiner*—John F. Pitrelli
*Attorney, Agent, or Firm*—Fulwider, Patton, Rieber, Lee & Utecht

[57] ABSTRACT

A portable dynamic advertising display system comprising an endless display path formed by an assembly of communicating track sections, adjustable supports including cross supports carrying the display path and drive means carried by one of the cross supports. A plurality of advertising signs are dependingly carried below the display path by roller assemblies carried along a guide rail disposed within the display path. The roller assemblies are connected to and carry an endless drive belt which moves the roller assemblies and dependent signs about the display path. The system is adapted for assembly and disassembly by a minimum of personnel and readily disassembled, transported and reassembled at a new site.

13 Claims, 8 Drawing Figures

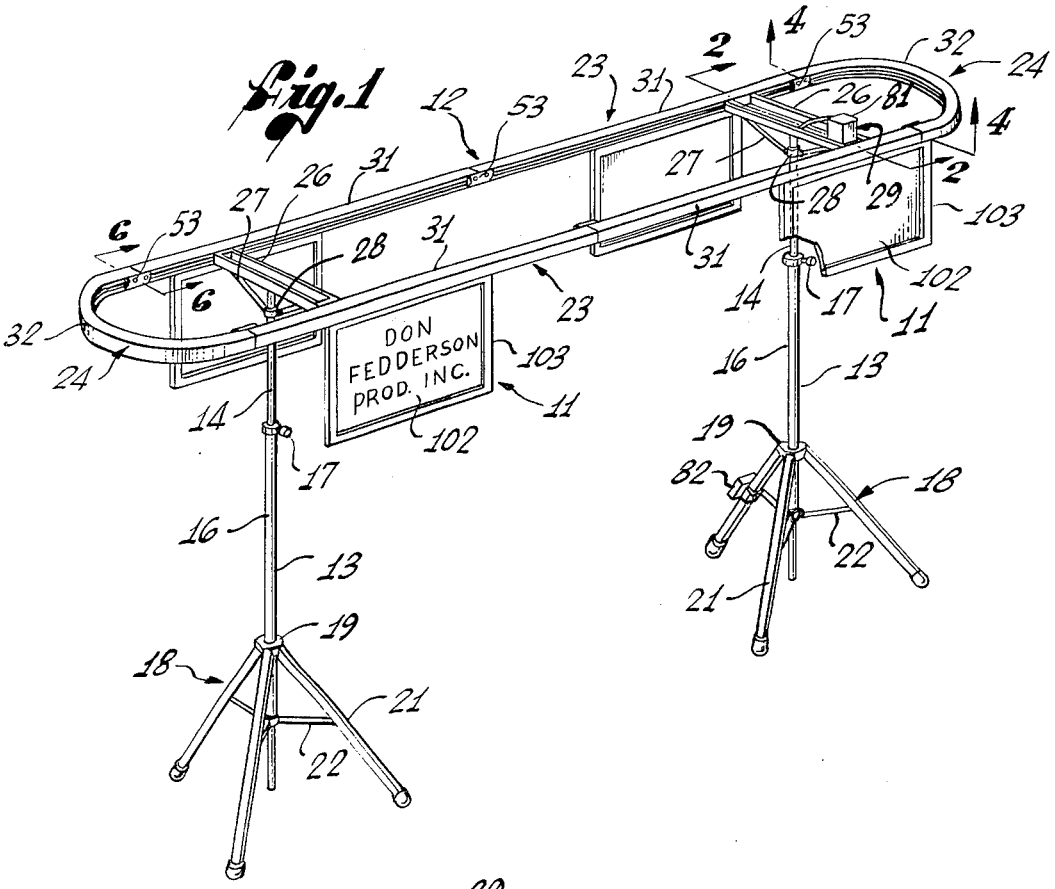
Fig. 1
DON
FEDDERSON
PROD. INC.
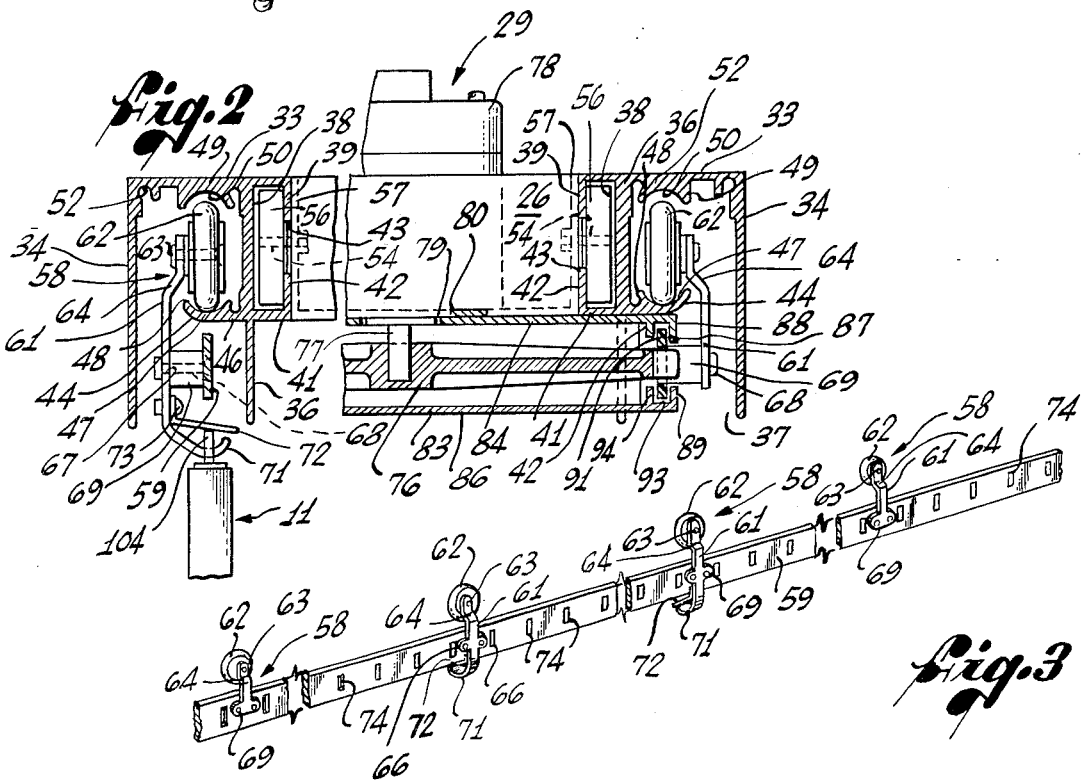
Fig. 2
Fig. 3

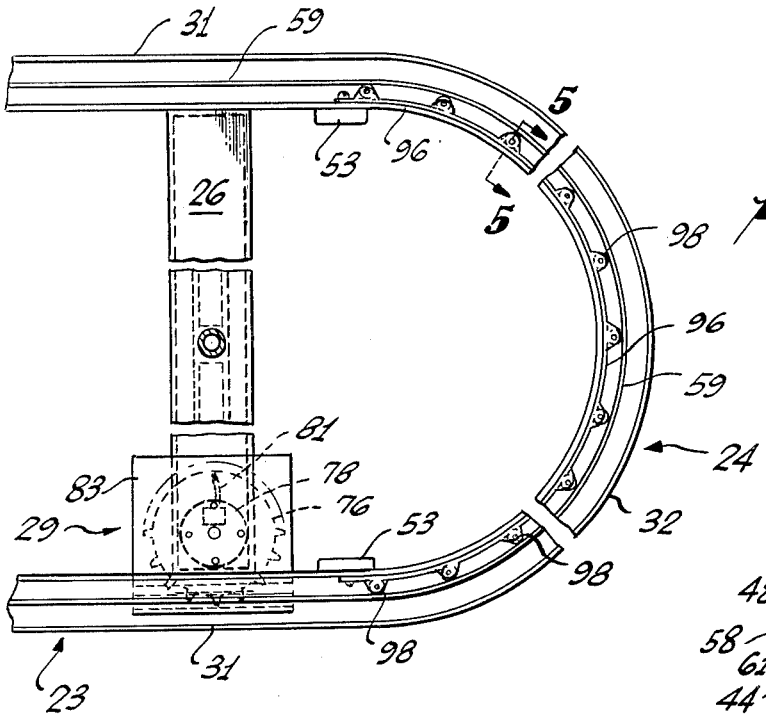
Fig. 4
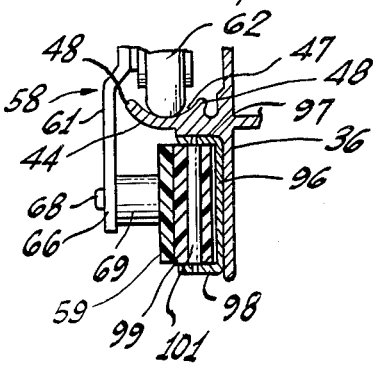
Fig. 5
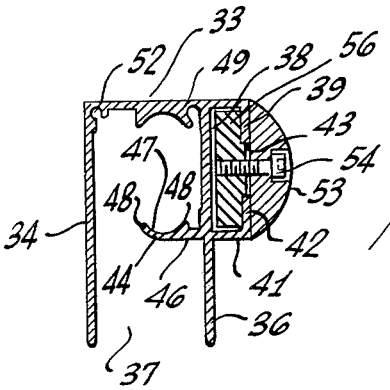
Fig. 6
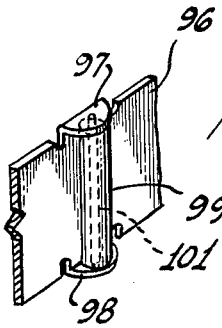
Fig. 7
Fig. 8
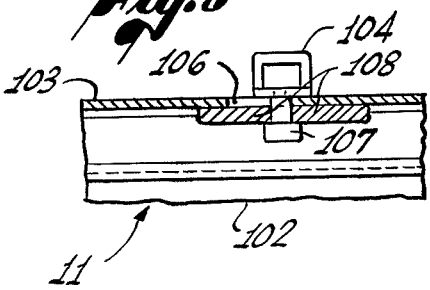

PORTABLE DYNAMIC ADVERTISING DISPLAY SYSTEM

BACKGROUND OF THE INVENTION

This invention relates to advertising displays and, more particularly, to an improved portable dynamic display system for exhibiting advertising signs.

In the field of advertising, the use of eye catching signs is recognized as an effective way to convey information and to promote products. Typically, the advertising signs and display systems of the general nature to which the present invention relates are artistically created and placed in strategic locations within a store, supermarket or the like, as a point of sale display to be seen by as many persons as possible. The effectiveness of such advertising is increased by utilizing a dynamic display system, thereby to more readily attract attention.

Examples of dynamic display systems of the general type to which the present invention relates are shown in U.S. Pat. No. 3,735,513 and application Ser. No. 424,864 filed Dec. 14, 1973 now U.S. Pat. No. 3,849,919. In devices of these types, advertising signs are sequentially extracted from a magazine and moved in series along a path to an opposing magazine or returned to the same magazine for storage prior to re-display. The magazine is provided with a discharge station where the sign is engaged with drive means for travel along a display path track, and a receiving station where the sign is disengaged from the drive means. The signs not being displayed are stored in the magazines and means are provided therein to move the signs from the receiving station through the magazine and to the discharge station for recirculation. Although highly effective for the purpose, dynamic display systems incorporating magazines are bulky and require substantial reinforcement and permanent mounting. These devices can be disassembled and moved only with great difficulty.

The present invention represents an improvement over the magazine type dynamic display systems in that the device of the present invention is readily assembled and disassembled and easily transported from one location to another.

SUMMARY OF THE INVENTION

The present invention provides a dynamic display system for point of sale advertising wherein the device is easily assembled and disassembled and readily transported from one location to another. A plurality of advertising signs are moved along an endless display path and are continuously displayed therealong without the necessity of a bulky magazine for sign storage. The requirement for mounting means and reinforcement means is eliminated, thus adding to the portability and easy assembly and disassembly features of the present invention.

More specifically, the display path comprises a series of track sections which are assembled into the endless display path. The track sections support and guide a plurality of roller assemblies adapted to carry an endless drive belt which in turn cooperates with drive means, also carried by the display path, for movement of the roller assemblies along the track. The advertising signs are carried by roller assemblies adapted for that purpose and the signs depend downwardly from the display path for display. The closed ends of the display path, which define the return path, are adapted by means of idler roll assemblies for guiding the endless belt through the return path with a minimum of friction. The hanger means by which the advertising signs are connected to the roller assemblies are pivotably, slidably mounted on the signs for compensating movement which the roller assembly - sign combination travels about the return path.

Further features of the present invention reside in the elimination of complicated and bulky means for maintaining the proper tension between the drive means and the drive belt and in the convenient and simple means for assembly of the components of the display system of the present invention. Other features and advantages of the portable display system of this invention will become apparent from the following detailed description, taken in conjunction with the accompanying drawings, which illustrate by way of example, the principles of the invention.

FIG. 1 is a perspective view, illustrating a dynamic advertising display system embodying the invention and showing advertising signs moving along a closed display path in accordance with the present invention, a portion of one of the signs being cut away for clarity of illustration;

FIG. 2 is an enlarged sectional view, partially broken away for compactness of illustration, taken through line 2—2 of FIG. 1;

FIG. 3 is an enlarged fragmentary perspective view of the drive belt and roller assemblies with portions of the drive belt cut away for compactness of illustration;

FIG. 4 is an enlarged top sectional view taken through line 4—4 of FIG. 1, with portions of the track return path and drive means support member cut away for compactness of illustration;

FIG. 5 is an enlarged fragmentary sectional view illustrating the lower portion of the display track taken through line 5—5 of FIG. 4;

FIG. 6 is an enlarged sectional view taken through line 6—6 of FIG. 1;

FIG. 7 is an enlarged fragmentary perspective view of an idler roll assembly located on a return section of the display path; and FIG. 8 is an enlarged fragmentary sectional view of the upper portion of an advertising sign illustrating the hanger assembly.

DETAILED DESCRIPTION

Referring to the drawings wherein like reference characters refers to like parts throughout the several figures, the present invention is embodied in a new and improved portable dynamic display system for displaying advertising panels, shown generally as 11, by the movement thereof about a closed display path shown generally as 12. The display path 12, when in the operative mode, is supported by at least a pair of longitudinally spaced apart, adjustable upstanding support means 13 which are themselves adapted for ease of portability by the provision of a telescoping tube 14 slidingly disposed within a tubular support member 16 for adjustment of the height of the support means 13. A locking bolt 17 is carried at the upper end of the tubular support element 16 for clamping the tube 14 in a position relative to the tubular support element. A foldable tripod assembly, shown generally as 18 including a head member 19 disposed about the lower portion of the tubular support member 16 and legs 21 pivotally connected at one end to the head member and being outwardly downwardly biased when in the unfolded supporting position, provides a stable base for the support means 13. The legs 21 are maintained in their supporting position by means of elongated foldable arms 22 which are pivotally connected at one end to a leg and at the opposite end to the tubular support member 16. The tripod assembly 18 is moved into the folded position when each of the elongated arms 22 are split and folded upwardly causing each of the legs 21 to be pivoted into a position parallel to the longitudinal axis of the tubular support member and each of the arms 22 are likewise pivoted into a nested position between its respective leg and the tubular support member. The legs 21 are channel shaped so that the arms 22 are nested within their respective legs when the tripod assembly 18 is in the folded mode.

As is more specifically shown in FIG. 1, the display path 12 defines an endless path consisting of the pair of parallel straight runs shown generally as 23 and a U-shaped return path 24 interconnecting the straight runs at either end of the display path. A cross support 26 is removably disposed on the upper end of each of the support means 13 and extends between the straight runs 23 of the display path 12 for carrying and supporting the display path. The cross supports 26 are adapted for ease of connection to the straight runs 23 and the longitudinal spacing between cross supports 26 and resulting spacing between the support means 13 can be readily adjusted to accommodate variations in width between store aisles. A pair of opposed elongated arms 27 are pivotally connected at their inner ends to a mounting sleeve 28 slidingly disposed on the telescoping tube 14 and at their outer ends to the cross support adjacent each end thereof for maintaining the cross support substantially perpendicular to the support means 13. In the disassembled mode, the arms are pivoted into a compact nested position against the underside of the cross support 26. The outer end of each of the arms 27 is pivotally attached to the cross support 26 so that the arms fold upwardly when pivoted into the nested position.

The drive means, shown generally as 29, is mounted on one cross-support member.

It should be noted that a third cross-support and upright support, not shown, may be positioned substantially at the center of the display path 12 for further support of the straight runs 23. This is particularly desirable where the straight runs 23 are sufficiently long for some sagging to occur thus making the additional support necessary, for example when the straight runs 23 span two or more aisles in a store.

As illustrated in FIG. 1, each of the straight run portions 23 of the display path consists of a pair of elongated track sections 31, the inner ends of which are in end wise abutment to form the straight run. The ends of each straight run 23 are in abutment with the ends of a U-shaped track section 32 which defines the return path 24 of the display path 12. As mentioned above, additional straight track sections may be interposed between the elongated sections 31 of the straight runs 23 to increase the length thereof. Each of the track sections 31 and 32 are removably butted together for ease of assembly and disassembly of the display path 12 and the length of the straight track sections 31 is such as to be conveniently carried in a station wagon or pick-up truck, when in the disassembled form.

As is more specifically shown in FIGS. 2 and 6, each of the sections 31 and 32 comprises in cross-section a generally hollow rectangular shape having a top wall 33 an outer wall 34, an inner wall 36 and is open at the bottom 37. A slotted mounting channel 38 is disposed along the exterior of the inner wall 36 and is defined by an extension of the top wall 33 carrying a downwardly turned lip 39 and a flange 41 downwardly spaced from the top wall extension and extending perpendicularly from the exterior surface of the inner wall 36. The flange 41 terminates in an upwardly turned lip 42. The edges of the lips 39 and 42 are spaced apart to define a slot 43 therebetween for access to the interior of the mounting channel 38 and for the extension therethrough of bolts for clamping the sections together in a manner to be described hereinafter.

As illustrated, the mounting channel 38 extends about the entire display path 12 parallel to the longitudinal axis thereof. It should be clear, however, that the mounting channel 38 need not be continuous in the manner shown but may be discontinuous and disposed along the display path 12 only at points of connection of the track sites 31 and 32 and the cross support 26.

A guide rail 44 is disposed interiorly of the inner wall 36 and is carried thereon by a flange 46. The guide rail 44, which runs parallel to and continuously along the inner wall 36 of each of the sections 31 and 32, defines a guide path 47 and upwardly raised edges 48. The inner surface of the top wall 3 is provided with a downwardly depending ridge 49, the lower surface of which is provided with a downwardly opening groove 50 which is vertically aligned with the guide path 47 of the guide rail 44.

Guide pin sockets 52 are located at the corner areas defined by the juncture of the top wall 33 with the outer wall 34 and the inner wall 36 and by the juncture of the flange 46 and the inner wall for receiving the ends of guide pins, not shown, which aid in aligning the ends of the track sections 31 and 32 for end-to-end abutment during assembly.

As previously mentioned the display path 12 is comprised of a pair of parallel straight runs 23 consisting of straight track sections 31, the outer end of which are in endwise abutment with U-shaped sections 32 which define the return path 24. The guide rails 44 of each of the sections 31 and 32 are likewise in abutment so that the guide path 47 of each section is in communication with the guide path 47 adjacent track sections. Each track section 31 and 32 is adapted for easy assembly and disassembly so that the system of the present invention can be easily transported between points of display and conveniently assembled with a minimum of personnel and in a minimum of time.

As is more specifically shown in FIGS. 1 and 6, a preferred method of maintaining the straight sections 31 and the U-shaped sections 32 in their assembled positions is by means of splice clamps 53 positioned along the mounting channel 38 and extending between abutting ends of sections to maintain the sections in position. Each splice clamp 53 bears against the outer surfaces of lips 39 and 42 of adjacent sections to maintain the sections in endwise abutment. The clamping action is achieved by drawing the splice clamp 53 inwardly against the lips 39 and 42 by means of bolt 54 which extends through the splice clamp and the slot 43 of the mounting channel 38 and is threadably engaged with a plate 56 disposed within the mounting channel. It is preferred to countersink the splice clamp 53 so that the head of the bolt 54 is at least flush with the external surface of the clamp when the bolt is drawn down.

Assembly of the cross support 26 and the straight sections 31 is similarly accomplished. As is most clearly shown in FIG. 2, the cross-support 26 is provided at either end with an upstanding flange 57 having an aperture, not shown, through which at least one bolt 54 extends for threadable engagement with the plate 56 in the mounting channel. The clamping action is as described for the splice clamp 53. The same size bolt 54 may be utilized both for securing the cross-support and the splice clamp 53 so that a single wrench may be used to assemble the display path 12.

The plate 56 is freely slidable in the mounting channel 38 until drawn by the bolt 54 against the lips 39 and 42. In this manner adjustment of the position of the end of the cross support 26 longitudinally along the track section 31 is readily accomplished by backing off the bolt 54 at each end of the cross support until the flange 57 and plate 56 are sufficiently loosened to permit their sliding along the lips 39 and 42 of the mounting channel 38.

A plurality of spaced apart roller assemblies, shown generally as 58, are disposed about the display path 12 and are supported on the guide path 47 of the track sections 31 and 32 for travel thereabout. An endless drive belt 59 is also disposed about the display path 12 and the drive belt is carried within the track sections 31 and 32 by means of attachment to the roller assemblies 58 so that the roller assemblies are moved responsive to the movement of the drive belt by the drive means 29.

As is more specifically shown in FIGS. 2 and 3, each roller assembly 58 comprises an elongated vertically oriented body 61 having a roller 62 rotably attached at its upper end for rotation about an axis defined by the shaft of a rivet 63. An upper portion of the body 61 is inwardly biased at 64 in order to insure clearance between the body and the guide rail 44 when the roller 62 is positioned on the guide path 47. The edges of the groove 50 and the raised edge 48 of the guide rail 44 are spaced apart to prevent the roller 62 from accidentally jumping from the guide path 47.

A pair of opposed ears 66 extend normally to the longitudinal axis of the body 61 in spaced relation to the upper end thereof. Each ear 66 is provided with an aperture 67 through which extends a rivet 68 for attachment of the drive belt 59 to the body 61. A spacer 69 is interposed between the drive belt 59 and the body 61 at the point of attachment to maintain the drive belt in inwardly spaced relation to the body of the roller assembly 58. The ears 66 are spaced downwardly from the upper end of the body 61 so that the drive belt 59 is disposed in the track sections 31 and 32 in the area below the guide rail 44 defined by the lower surface of the guide rail, the outer wall 34 and the inner wall 36.

As more specifically shown in FIG. 3, at least two of the roller assemblies 58 are adapted for carrying an advertising sign 11 by extending the lower end of the body 61 to a point below the drive belt 59. The lower end is inwardly upwardly turned to define an upwardly opening hook 71 for carrying the sign 11. A leaf spring 72 is mounted on the lower portion of the body and extends across and normally closes the open area of the hook 71 to prevent the advertising sign 11 from accidentally jumping off of the hook during operation. The leaf spring 72 is retained on the body 61 by means of rivet 73.

As will be described hereinafter, it is preferred that the roller assemblies 58 adapted for carrying the signs 11 be disposed in pairs along the drive belt 59. The number of pairs and the spacing therebetween is predetermined by the size and maximum number of the signs 11 to be carried along the display path 12 as well as the desired spacing between the signs.

The drive belt 59 is an endless belt having a width substantially greater than its thickness. A plurality of through running spaced apart slots 74 are disposed along the entire belt 59 for engagement with a drive sprocket 76. It should be noted that the spacing between the outer edges of the ears 66 of the body 61 of each of the roller assemblies 58 is such that the body, including the ears is accommodated on the belt 59 in the spacing between the through running slots 74 for effecting the attachment of the drive belt and the spacers 69 to the roller assemblies.

The drive belt 59 is formed of a flexible material, which, preferably, has a low modulus of elasticity. In the preferred embodiment, the drive belt 59 is a laminated structure comprising an inner core of woven material such as for example, cotton, for stretch resistance and wear resistance, and surface layers or coatings of an elastomeric material such as for example, neoprene, to give the drive belt body and to act as a noise suppressor during operation of the drive belt.

As im more specifically shown in FIGS. 2 and 4, the drive means 29 comprises the drive sprocket 76 carried on a drive shaft of a vertically oriented electric motor 78. The drive means 29 is disposed on a cross support 26 adjacent one of the straight run sections 23 and is spaced inwardly therefrom so that the teeth of the drive sprocket at the outermost point of travel extend into the straight run section through the slots 74 of the drive belt 59 for driving the belt about the display path responsive to the rotation of the drive sprocket. A portion of the inner wall 36 of the section 31 adjacent the drive sprocket 76 is cut away to permit access by the sprocket to the drive belt 59. The motor 78 is mounted on the cross support member 26 in any conventional manner, such as by bolts, not shown, with insulative material 80 interposed between the motor and cross-support for noise suppression. It is preferred that the transverse dimension of the cross support be of sufficient width to provide a mounting platform for the motor. An aperture 79 is provided in the cross support member for the extension therethrough of the drive shaft 77. A cover, not shown, is further provided about the motor 78 to protect the motor from damage as well as to esthetically enhance the appearance of the assembly.

The motor 78 is connected to a source of current, not shown, by means of a current conducting line 81 extending from the motor, through the telescoping tube 14 of the upright support 13 to an electrical timer assembly 82 located on one of the legs 21 of the tripod assembly 18. The timer 82 includes a receptacle, not shown, to which the electrical current is led from the source for automatically controlling the operation of the motor 78.

A housing 83 comprising an upper member 84 and a removable cover 86 is carried on the under surface of the cross support 26 and encloses the drive sprocket except for the wall adjacent the track section 31 which is provided with a slot 87 which extends across the length of the wall. The slot 87 is defined between a downturned lip 88 formed on the edge of the upper member 84 adjacent the track section 31 and an upturned lip 89 on the removable cover 86 which is vertically aligned with the lip 88. A downwardly opening belt guide channel 91 extends parallel to the lip 88 on the upper member 84 and is defined between the lip 88 and an inwardly spaced, parallel running flange 92. The removable cover 86 is provided with a similar upwardly opening belt guide channel 93 which is defined between the lip 89 and an inwardly spaced parallel running flange 94. When the housing 83 is assembled, the belt guide channels 91 and 93 are vertically aligned and act to guide the drive belt 59 as it engages and disengages with the drive sprocket 76.

During operation of the dynamic advertising system of the present invention, a substantial amount of frictional drag will normally result due to contact between the drive belt 59 and the inner wall 36 of the U-shaped track sections 32 as the drive belt passes therethrough. This frictional drag may also result in the imparting of discontinuous or jerky motion which is highly undesirable. To reduce the frictional drag and insure smooth continuous belt motion, means are provided in the U-shaped sections 32 to reduce belt drag.

As is more specifically shown in FIGS. 4, 5 and 7 a liner 96 is disposed on the interior face of the inner wall 36 of the track sections 32. A plurality of aligned pairs of upper and lower tabs, 97 and 98 respectively, are spaced along the upper and lower edge of the liner 96. A freely rotatable idler roller 99 is mounted between each pair of tabs, 97 and 98 by a through running pin 101, the ends of which are anchored to the tabs 97 and 98 by suitable means such as in aligned apertures, not shown, in the upper and lower tabs through which the ends of the pin extend.

As mentioned above, the advertising signs 11 are carried by the hook 71 of the body 61 of the roller assembly 58 and in this manner depend downwardly from the display path 12 for movement therearound. The advertising signs 11 comprise a sign portion 102 on which a suitable advertising message is displayed and a hollow frame 103, the upper edge of which carries two hangers 104 for engagement with the hooks 71. It is preferred, in view of the length of the advertising signs 11 to provide a hanger 104 adjacent each end of the advertising sign so that the sign is carried by two roller assemblies 58 for greater stability during operation. To this end, it will be apparent that the spacing between the hangers 104 and the spacing between the roller assemblies 58 will be equal. It has been found, however, that when supporting the advertising signs 11 at two points as described it is preferred to provide the hangers 104 with limited freedom of movement with respect to the sign to facilitate the carrying of the advertising signs about the relatively small radius of the U-shaped track section 32 of the display path 12.

Referring more specifically to FIG. 8, an elongated mounting slot 106 is provided in the upper edge of the frame 103 of the sign 11. The hanger 104 is carried thereat by a collar bolt 107 which threads into the base of the hanger and extends through the elongated mounting slot 106 and a supporting plate 108. The low friction supporting plate 108 is disposed on the shaft of the collar bolt 107 for sliding contact with the undersurface of the upper edge of the frame 103. The supporting plate 108, which is formed from a suitable a low friction material such as for example teflon or polyacetal resin, is substantially larger than the elongated mounting slot 106 so as to provide carrying support for the collar bolt 107 and hanger 104. In this manner, the hanger 104 is free to rotate about an axis defined by the shaft of the collar bolt 107 and is also free to move in a longitudinal direction within the elongated slot 106 to compensate for the change of direction and relative spacing between the roller assemblies 58 carrying the sign 11 as the roller assemblies travel about the U-shaped section 32.

As previously mentioned, the device of the present invention is readily assembled at the point of display and requires a minimum of personnel and tools. Assembly normally requires two individuals and is carried out by mounting the cross support members 26 on the telescoping tube 14 of the upright support 13. The straight track sections 31 are assembled and clamped on the ends of the cross support members 26 to form the straight runs 23. One of the U-shaped sections 32 is positioned at one end of the straight run sections 23. The lower cover 86 and drive sprocket 76 are removed. The drive belt 59 is then fed through one open end of one of the straight run sections 23 and the rollers 62 of the roller assemblies 58 positioned on the guide path 47 of the assembled track sections 31 and 32. In this manner the drive belt 59 is positioned within the straight run sections 23 and one U-shaped section 32 with one end of the drive belt being free at the open ends of the straight run sections. The remaining U-shaped section 32 is then threaded about the free end of the drive belt 59 and clamped into position on the remaining open ends of the straight run sections 23. The drive sprockets 76 is then positioned on the drive shaft 77 of the motor 78 and aligned so that a tooth is aligned with and extends through a slot 74 of the drive belt 59. The removable lower cover 86 is then placed in position and the advertising signs 11 placed on the hooked lower ends 71 of the roller assemblies 58 which are to carry the signs 11. The telescoping tube 14 of each of the upright supports 13 are adjusted for desired height and the device is ready for operation. Dismantling is carried out in substantially the reverse order.

From the foregoing it can be seen that a highly portable, easily assembled and disassembled dynamic display system is provided. In accordance with the present invention, the device can be assembled and disassembled with a minimum of tools by relatively unskilled personnel. By providing the drive means along a straight run of the display path, the necessity of cumbersome and complicated reinforcing means for the return path portion is eliminated thereby greatly simplifying the assembly of the device. Likewise, by combining the drive belt and roller assemblies in the manner described herein, the drive mechanism is substantially simplified. The device is quiet in operation and has low power requirements.

While a particular form of the invention has been illustrated and described, it will be apparent that various modifications can be made without departing from the spirit and scope of the invention.

I claim:

1. A dynamic advertising display system comprising:

an endless display path including two spaced apart elongated tubular straight run sections extending parallel to each other and a generally U-shaped tubular return path section extending between and communicating with the interiors of said straight run sectons at each end thereof, each of said straight run sections and said U-shaped sections having inner and outer side walls defining an open bottom, means disposed in the interior of each of said straight run sections and said U-shaped sections defining an endless guide path extending about the interior of said display path;

a plurality of roller assemblies disposed in spaced relation about the interior of said display path and carried by said guide path, each said roller assembly comprising an elongated body, the upper end of which extends above said guide path and having a roller journaled thereon for rotation about an axis normal to the longitudinal axis of said body and for travel along said guide path, the lower end of said body extending below said guide rail, at least one of said elongated bodies being adapted for carrying an advertising sign, an endless drive belt disposed about said display path, said drive belt being affixed to each of said elongated bodies of said roller assemblies;

support means for said display path including a cross support extending between the end portions of said straight run sections and attached thereto and a vertically adjustable upright support attached to said cross support for supporting said display path for display of said advertising sign;

drive means carried by one of said cross supports adjacent one of said straight run sections for driving engagement with said drive belt as it passes along said straight run section; and a plurality of idler rollers rotatably disposed in each of said U-shaped sections along the interior wall thereof for rotation about a vertical axis, said rollers being in contact with said drive belt as it passes through said U-shaped section for reducing frictional resistance and guiding said drive belt about said U-shaped section.

2. The display system as defined in claim 1 wherein said drive means comprises a vertically oriented motor mounted on an upper surface of said cross support and including a drive shaft extending below said cross support, a drive sprocket disposed on said drive shaft for rotation about a vertical axis, said drive means being spaced away from said straight run section so that the periphery of said drive sprocket extends into said straight run section for driving engagement with said drive belt.

3. The display system of claim 2 wherein an opening is provided on the inner wall of said straight run section adjacent said drive means for the extension therethrough of said drive sprocket.

4. The display system as defined in claim 2 wherein said spaced apart slots are disposed along said drive belt, the spacing between adjacent slots being equal to the spacing between adjacent teeth of said drive sprocket for the extension thereof through said slots for driving said drive belt about said display path.

5. A dynamic advertising display system comprising:

a plurality of advertising signs, each sign including a sign portion and a frame disposed about said sign portion;

an endless display path including two spaced apart elongated tubular straight run sections extending parallel to each other and a U-shaped tubular return path section extending between and communicating with the interiors of said straight run sections at each end thereof, each of said straight run sections and said U-shaped sections being open along the bottom face thereof, means disposed in the interior of each of said straight run sections and said U-shaped sections defining an endless guide path extending about the interior of said display path;

a plurality of roller assemblies disposed in spaced relation about the interior of said display path and carried by said guide path, each said roller assembly comprising an elongated body, the upper end of which extends above said guide path and having a roller journaled thereon for rotation about an axis normal to the longitudinal axis of said body and for travel along said guide path, the lower end of said body extending below said guide rail, selected ones of said elongated bodies being adapted for carrying said advertising signs;

means coupling said advertising signs to said selected elongated bodies, said means comprising upwardly extending hangers disposed on the upper edges of said frames for removable attachment to said selected elongated bodies, each of said hangers being free to rotate about a vertical axis and being adapted for limited movement parallel to the longitudinal axis of said display path, an endless drive belt disposed about said display path, said drive belt being affixed to each of said elongated bodies of said roller assemblies;

support means for said display path including a cross support extending between the end portions of said straight run sections and attached thereto and a vertically adjustable upright support attached to said cross support for supporting said display path for display of said advertising sign; and drive means carried by one of said cross supports adjacent one of said straight run sections for driving engagement with said drive belt as it passes along said straight run section.

6. The display system as defined in claim 5 wherein said lower end of said elongated body of at least one of said roller assemblies is extended downwardly inwardly to define an upwardly opening hook for carrying said advertising sign.

7. The display system of claim 5 further including a spacer disposed between said lower end of said elongated body of said roller assembly and said drive belt at the point of attachment thereof whereby said drive belt is carried in said display path in spaced relation to said elongated body of each of said roller assemblies.

8. A dynamic adverising display system comprising:

an endless display path including two spaced apart elongated tubular straight run sections extending parallel to each other and a U-shaped tubular return path section extending between and communicating with the interiors of said straight run sections at each end thereof, each of said straight run sections and said U-shaped sections being open along the bottom face thereof, means disposed in the interior of each of said straight run sections and said U-shaped sections defining an endless guide path extending about the interior of said display path;

A plurality of roller assemblies disposed in spaced relation about the interior of said display path and carried by said guide path, each said roller assembly comprising an elongated body, the upper end of which extends about said guide path and having a roller journaled thereon for rotation about an axis normal to the longitudinal axis of said body and for travel along said guide path, the lower end of said body extending below said guide rail, at least one of said elongated bodies being adapted for carrying an advertising sign;

an endless drive belt disposed about said display path, said drive belt being affixed to each of said elongated bodies of said roller assemblies;

support means for said display path including a cross support extending between the end portions of said straight run sections and attached thereto and a vertically adjustable upright support attached to said cross support for supporting said display path for display said advertising sign;

a longitudinally running mounting channel disposed about said display path, said mounting channel defined by an upper and lower flange extending perpendicularly from the exterior face of the inner wall of said straight run sections and said U-shaped section, said upper flange terminating in a downwardly turned lip and said lower flange terminating in an upwardly turned lip, the edges of said lips being spaced apart to define a slot for access to the interior of said mounting channel, and clamping means acting against said lips for retaining said straight run sections and said U-shaped sections in end-wise abutment and for attaching said cross supports to said straight run sections; and drive means carried by one of said cross supports adjacent one of said straight run sections for driving engagement with said drive belt as it passes along said straight run section.

9. A dynamic advertising display system comprising:

an endless display path including a pair of laterally spaced, generally straight run sections interconnected by generally U-shaped end sections, each of said sections having inner and outer sidewalls defining an open bottom, and having track means therein defining an endless guide path throughout said display path;

a plurality of roller assemblies disposed in spaced relation along said display path and including rollers supported by said track and elongatted bodies coupled to said rollers and projecting downwardly therefrom, selected ones of said bodies having means for attaching advertising signs to said selected bodies;

an endless drive belt of generally rectangular cross-section secured to said elongated bodies below said track, said belt being formed of flexible material having a low modulus of elasticity to prevent substantial stretching of said belt, and including an elastomeric coating over the surface thereof; and drive means disposed adjacent one of said straight run sections and including a drive motor coupled to a drive gear having teeth adapted to intercept said drive belt along said straight run section, said belt including means permitting said teeth to drivingly engage said belt and move said roller assemblies over said track about said display path, said drive gear being disposed relative to said belt to permit only a limited number of said teeth to engage said belt at any given time and to not significantly deflect said belt from its straight line travel along said one straight run section, whereby said limited engagement of said belt by said teeth tends to reduce wear of said belt caused by said teeth.

10. A dynamic advertising display system as defined in claim 9 in which said means for permitting said teeth to drive said belt comprise generally rectangular sprocket holes regularly spaced along said belt and dimensioned to receive said teeth one at a time.

11. A dynamic advertising display system as defined in claim 9 including support means for said display path, said support means including a cross support extending laterally between said straight run sections and secured thereto, and a vertically adjustable upright support attached to said cross support.

12. A dynamic advertising display system as defined in claim 11 wherein said drive motor is attached to said cross support.

13. A dynamic advertising display system as defined in claim 9 including a plurality of idler rollers rotatably disposed about the inner side wall of said U-shaped end sections, said rollers being in contact with said drive belt as it passes through said U-shaped section for reducing frictional resistance and guiding said drive belt about said U-shaped sections.

* * * * *